United States Patent [19]

Klodt

[11] Patent Number: 5,056,945

[45] Date of Patent: Oct. 15, 1991

[54] WRITING INSTRUMENT GRIP

[75] Inventor: Gerald J. Klodt, Madison, Wis.

[73] Assignee: W. T. Rogers Company, Madison, Wis.

[21] Appl. No.: 578,752

[22] Filed: Sep. 4, 1990

[51] Int. Cl.[5] ..... B43K 23/00

[52] U.S. Cl. ..... 401/6; 401/88; 401/91

[58] Field of Search ..... 401/6, 88, 91

[56] References Cited

U.S. PATENT DOCUMENTS

| | | | |
|---|---|---|---|
| 249,893 | 11/1881 | Bulkeley . | |
| 447,873 | 3/1891 | Hanimann . | |
| 794,329 | 7/1905 | Whitehouse . | |
| 843,767 | 2/1907 | Plach . | |
| 945,026 | 1/1910 | Faust . | |
| 1,291,972 | 1/1919 | McGuigan . | |
| 1,793,945 | 2/1931 | Mauthe . | |
| 1,879,456 | 9/1932 | Parsons . | |
| 2,236,194 | 3/1941 | Lorber . | |
| 2,594,955 | 4/1952 | Markowitz . | |
| 3,947,977 | 4/1976 | Bishop . | |
| 4,030,841 | 6/1977 | Balasty . | |
| 4,076,427 | 2/1978 | Anderson . | |
| 4,149,811 | 4/1979 | Coffman . | |
| 4,167,347 | 9/1979 | Hoyle . | |
| 4,526,547 | 7/1985 | Rusk . | |
| 4,595,307 | 6/1986 | Heyden | 401/91 X |
| 4,601,598 | 7/1986 | Schwartz et al. | 401/6 |
| 4,932,800 | 6/1990 | Lin et al. | 401/6 |

FOREIGN PATENT DOCUMENTS

| | | | |
|---|---|---|---|
| 39911/72 | 9/1973 | Australia . | |
| 2655532 | 6/1978 | Fed. Rep. of Germany | 401/6 |
| 437062 | 4/1912 | France | 401/88 |
| 250085 | 8/1947 | Switzerland | 401/91 |
| 3922 | of 1903 | United Kingdom | 401/6 |

OTHER PUBLICATIONS

Grab On ® "Get A Grip On It!", Grab On Products, 100 N. Avery, Walla Walla, Wash. 99362.

*Primary Examiner*—Steven A. Bratlie
*Attorney, Agent, or Firm*—Lathrop & Clark

[57] ABSTRACT

A grip for a writing instrument is disclosed which has a resilient plastic hollow tube with a plurality of flexible interior ribs extending radially inwardly from the tube and extending axially the length of the tube. A plurality of flexible exterior ribs extend radially outwardly from the tube and extend axially the length of the tube. The interior ribs are adapted to resiliently engage the shank of a writing instrument and the exterior ribs are preferably tapered and provide a resilient, cushioning grip to a writer. The radial thickness of the tube of the grip is small in comparision to the diameter of the tube so that the tube may be inverted or reversed so that the interior ribs extend radially outwardly and the exterior ribs extend radially inwardly. By reversing the grip, the resilient feel of the grip may be modified and the grip may be adapted to writing instruments of lesser diameter.

6 Claims, 2 Drawing Sheets

WRITING INSTRUMENT GRIP

FIELD OF THE INVENTION

This invention relates generally to finger grips for writing instruments and particularly to grips which may be adjusted to accommodate writing instruments of varying dimensions.

BACKGROUND OF THE INVENTION

Many writing instruments, for example, lead pencils, fountain pens, ball point and felt tip pens, crayons, and markers, have smooth exterior surfaces for ease in manufacture or aesthetic appearance purposes. While a smooth surface may be attractive and pleasant to the touch, it presents several drawbacks when embodied in a writing instrument.

When held in a writer's hand for an extended length of time, the writing instrument will tend to become slippery as a result of the liquids given off by the fingers of the writer. This slickness makes the writing instrument difficult to grasp causing the writer discomfort and resulting in impaired legibility of the writing produced.

Grips which may be attached to pens, pencils and the like are well known to the art. Many of these grips are designed to force the writers fingers into a desired grip which has been deemed correct. Grips which force the fingers of the writer into a particular configuration are not always comfortable for writers who prefer to hold their pencil in a different manner.

Other known grips are designed primarily to facilitate the writer's grasp on the writing instrument without the instructional or corrective functions of the devices mentioned above. A feature of such grips, however, is that the exterior profile is non-uniform thus constraining a writer to hold his writing instrument in a fixed position. Not only can this cause fatigue in the writer, in the case of a lead pencil it prevents the writer from rotating the pencil to best obtain even wear of the lead.

Grips are known which utilize projecting interior ribs for frictional attachment to a writing instrument. However, the dimensions of any particular set of ribs will limit the size writing instrument to which the grip may be attached.

What is needed is a grip to facilitate writing with a writing instrument, despite the exterior surface finish of that instrument, which permits a variety of grasping positions and which is adjustable to different diameter writing instruments.

SUMMARY OF THE INVENTION

The grip for a writing instrument of this invention has a resilient plastic hollow tube. A plurality of flexible exterior ribs extend radially outwardly from the tube and extend axially the length of the tube. A plurality of flexible interior ribs extend radially inwardly from the tube and extend axially along the length of the tube. The interior ribs are shorter than the exterior ribs. The walls of the tube are thin in comparison to the diameter of the tube so that the tube may be inverted such that the interior ribs extend radially outwardly and the exterior ribs extend radially inwardly. If desired the ribs may be formed with a taper.

It is an object of the present invention to provide a writing grip to facilitate the grasping of a writing instrument.

It is a further object of the present invention to provide a writing grip which is flexible to accommodate a variety of writing instruments.

Other objects, advantages, and features of the present invention will become apparent from the following specification when taken in conjunction with the accompanying drawings.

DESCRIPTION OF THE PREFERRED EMBODIMENT

Referring more particularly to the drawings, wherein like numbers refer to similar parts, FIGS. 1–6 show a grip 20 for a writing instrument. The grip 20 may be formed of natural or synthetic rubber but is preferably formed of a moldable, resilient plastic material such as Kraton, which is a styrenic-based plastic to which more or less styrene may be added to achieve a desired stiffness.

Figure 1:
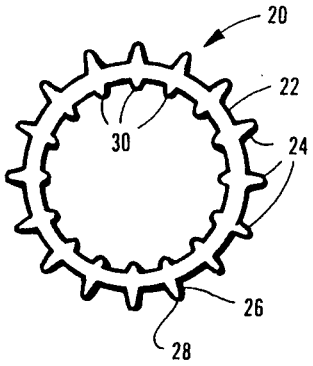
FIG. 1. is a front elevational view of the writing instrument grip of this invention.
Figure 2:
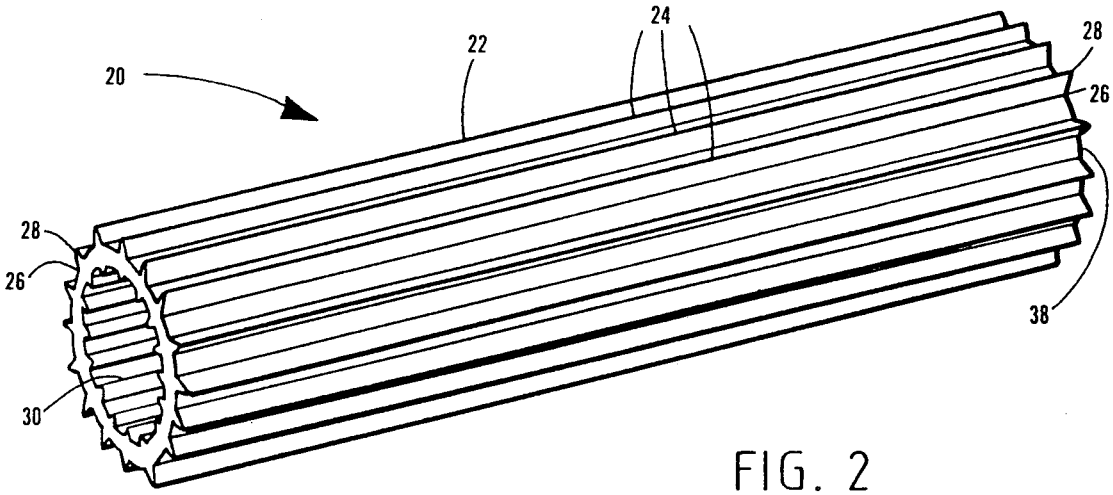
FIG. 2 is a side elevational view of the grip of FIG. 1.
Figure 3:
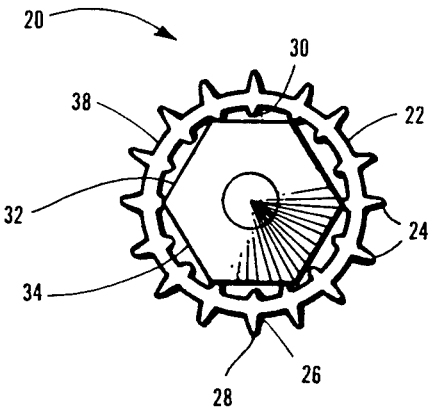
FIG. 3 is a front elevational view of the grip of FIG. 1 mounted on a writing instrument.
Figure 4:
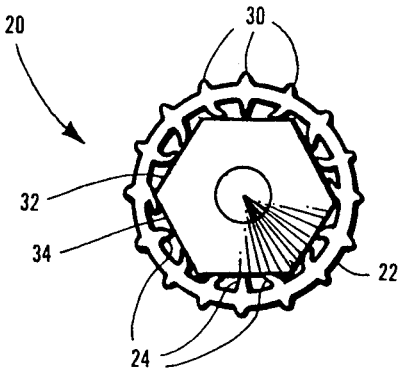
FIG. 4 is a front elevational view of the grip of FIG. 1 inverted and mounted on a writing instrument of narrower diameter than the one of FIG. 3.

As shown in FIG. 2, the body of the grip is a substantially cylindrical tube 22 which may be of any desired length but will typically be one to two inches long, preferably 1 $\frac{5}{8}$ inches. As shown in FIG. 1 the radial thickness of the tube 22 is small in comparison to the diameter of the tube. It has been shown that where the thickness is less than $\frac{1}{8}$ of the diameter of the tube 22 advantageous flexibility of the grip 20 will result, as shown by the reversible feature of the grip, shown in FIG. 6.

As best seen in FIG. 1, the tube 22 is provided with a plurality of flexible exterior ribs 24 which extend radially outwardly from the tube 22 and which extend axially the length of the tube. The exterior ribs 24 are evenly spaced around the circumference of the tube 22 and are preferably thinner than the thickness of the tube walls. The exterior ribs 24 are relatively short and provide the texture to the exterior surface of the grip 20 for grasping by the fingers of a writer. The radial extension of the exterior ribs 24 acts to prevent undesired rotation of the grip 20 when grasped by the fingers. To impart greater flexibility to the exterior ribs 24, they are preferably formed with a taper so that the base 26 of each exterior rib 24 is thicker than the tip 28 of each rib. An effective grip may be formed wherein the extension of the exterior ribs 24 from the surface of the tube 22 is less than $\frac{1}{8}$ of the diameter of the tube 22.

The interior of the tube 22 is formed with a plurality of flexible interior ribs 30. The interior ribs 30 extend radially inwardly from the inner surface of the tube and extend axially the length of the tube. The interior ribs 30 act to apply a resilient force to the surface of the writing instrument 32 to which the grip 20 is applied. The interior ribs 30 will generally be shorter than the exterior ribs 24 so as to provide less flexibility and a more secure grip.

Figure 5:
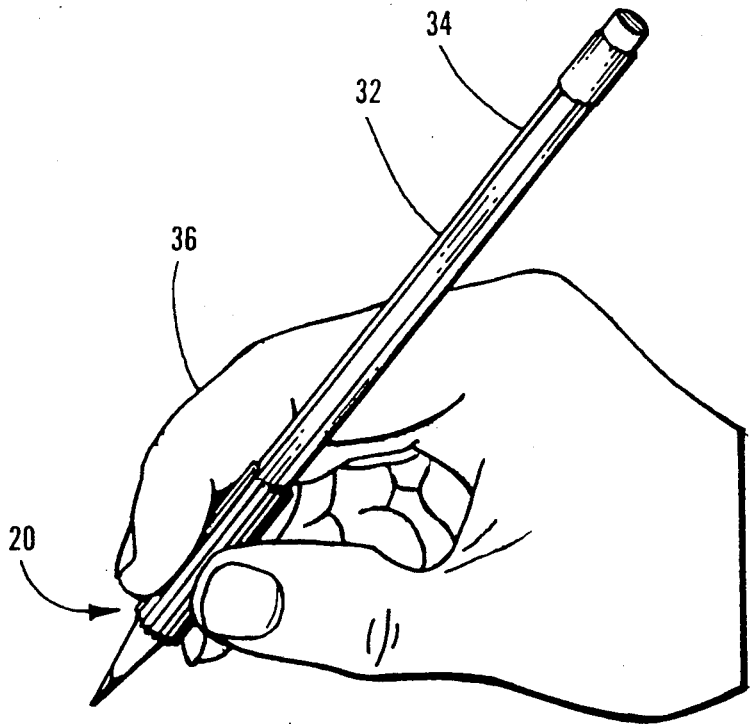
FIG. 5 is a perspective view of the grip of FIG. 1 mounted on a writing instrument and in use.

The grip 20 is affixed to a writing instrument 32 by inserting the writing instrument 32 into the tube 22 of the grip 20. Because of the tube's flexibility it may be pulled along the shank 34 of the writing instrument until it is in a convenient position. The shank 34 of the writing instrument 32 will then be in contact with the interior ribs 30 of the grip 20. The flexible tube 22 will tend to apply a compressive force to the writing instrument 32 serving to hold the grip 20 in place when grasped by a writer's hand as shown in FIG. 5.

The pressure of the writer's fingers 36 on the exterior ribs 24 will cause the exterior ribs 24 to bend and deform downward onto the surface areas 38 of the tube 22 intermediate the exterior ribs 24. The exterior ribs 24 are preferably spaced sufficiently far apart that when one rib is deformed onto the surface area 38 it does not interfere with any other exterior rib 24. Because of the readily deformable properties of the exterior ribs 24, the grip 20 provides a cushioning sensation to the writer's fingers 36. Furthermore, the surface areas 38 between the exterior ribs 24 serve as channels through which liquid such as sweat appearing on the skin of the writer's fingers 36 may be drained away.

Figure 6:
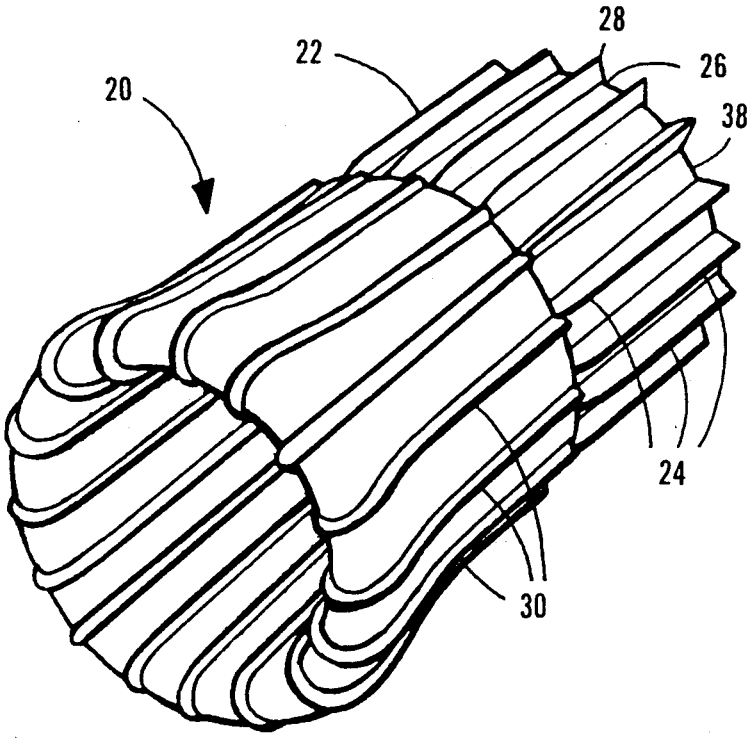
FIG. 6 is a perspective view of the grip of FIG. 1 in a partially inverted configuration.

The resilient cushioning effects of the grip 20 may be adjusted to suit the particular taste of a writer by simply rolling the tube 22 back onto itself. A partial reversal of the grip 20 is shown in FIG. 6.

A grip in accord with this invention will be flexible so as to be reversible.

The inverted grip 20 will have the shorter ribs on the exterior surface and the longer ribs on the interior surface. The effect of this reversal is that the grip will present a less resilient or spongy sensation to the writer's fingers 36. A further effect is that the grip will be able to accommodate writing instruments 32 of lesser diameter, because the ribs which are on the interior of the tube 22 now extend a greater distance inward.

When the writer utilizes the grip 20, he is not constrained to hold the pencil in any particular manner. Because the grip 20 is symmetrical with uniform ribs, he may rotate the writing instrument 32 with no loss in control or comfort. The ribs are such that they will mold themselves to fit the fingers of any writer regardless of his finger shape or preferred grip.

It is understood that the invention is not confined to the particular construction and arrangement of parts herein illustrated and described, but embraces all such modified forms thereof as come within the scope of the following claims.

I claim:

1. A grip for a writing instrument, comprising:

(a) a resilient hollow tube, adapted to fit snugly over the writing instrument;

(b) a plurality of uniform flexible exterior ribs extending radially outwardly from the tube and extending axially the length of the tube; and (c) a plurality of flexible interior ribs extending radially inwardly from the tube and extending axially the length of the tube, wherein the interior ribs are shorter than the exterior ribs; and wherein the radial thickness of the tube is small in comparison to the diameter of the tube, the tube being sufficiently resilient to permit the grip to be inverted so that the interior ribs extend radially outwardly and the exterior ribs extend radially inwardly to accommodate writing instruments of lesser diameter.

2. The grip of claim 1 wherein the thickness of the tube wall is less than $\frac{1}{8}$ of the diameter of the tube.

3. The grip of claim 1 wherein the extension of the exterior ribs is less than $\frac{1}{8}$ of the diameter of the tube.

4. The grip of claim 1 wherein each exterior rib has a tip at the end most distant from the tube and a base at the surface of the tube which is thicker tan the tip.

5. The grip of claim 1 wherein the distance along the tube surface between exterior ribs is such that when one exterior rib is deformed onto the tube surface it does not contact any other rib.

6. The grip of claim 1 wherein the grip is made of a styrene-based plastic.

* * * * *